United States Patent [19]

Sakamaki et al.

[11] 4,034,189

[45] July 5, 1977

[54] DEVICE FOR HEAT FIXATION

[75] Inventors: Hisashi Sakamaki, Yokohama; Toshiyuki Ohtani, Tokyo, both of Japan

[73] Assignee: Canon Kabushiki Kaisha, Tokyo, Japan

[22] Filed: May 30, 1975

[21] Appl. No.: 582,296

[30] Foreign Application Priority Data

June 4, 1974 Japan ..... 49-63217

[52] U.S. Cl. ..... 219/216; 219/469; 219/543; 338/306; 338/311; 338/334

[51] Int. Cl.[2] ..... H05B 1/00

[58] Field of Search ..... 219/543, 216, 469–471; 346/76 R; 338/307, 306, 308, 311, 334; 100/93 P, 93 RP

[56] References Cited

UNITED STATES PATENTS

| | | | |
|---|---|---|---|
| 2,796,913 | 6/1957 | Fener et al. | 219/543 X |
| 2,802,086 | 8/1957 | Fener | 219/243 X |
| 3,399,292 | 8/1968 | Boldridge | 219/469 |
| 3,469,077 | 9/1969 | Peterson | 219/469 |
| 3,478,191 | 11/1969 | Johnson et al. | 219/543 X |
| 3,495,070 | 2/1970 | Zissen | 219/543 X |
| 3,496,333 | 2/1970 | Alexander et al. | 219/543 X |

*Primary Examiner*—C. L. Albritton

*Attorney, Agent, or Firm*—Fitzpatrick, Cella, Harper & Scinto

[57] ABSTRACT

A device for heat fixation comprises a heating member comprising a heat resistant insulating support, a heat generating member provided on the support and a thin film of heat resistance, low surface tension and low friction coefficient overlying the heat generating member.

4 Claims, 10 Drawing Figures

DEVICE FOR HEAT FIXATION

BACKGROUND OF THE INVENTION

1. Field of the Invention

This invention relates to a device for heat fixation, and more particularly, to a device for heat fixation having an improved heating member suitable for electrophotographic apparatuses.

2. Description of the Prior Art

There are known various types of electrophotographic copying processes such as a process comprising forming an electrostatic latent image on a photoconductive material such as zinc oxide and the like coated on ordinary paper and developing the latent image directly and a process comprising forming an electrostatic latent image on a photoconductive material such as selenium, cadmium sulfide and the like mounted on a plate or drum, developing the latent image and transferring the developed image to a transfer member such as paper.

These electrophotographic processes suffer from the problem of heat fixation of the toner.

For example, visible images formed on a photosensitive plate are transferred to a copying member such as paper to produce transferred images and then heated for fixing the transferred images. When the toner of the image is composed of thermoplastic resin powders containing a coloring pigment, the toner is plasticized and softened by heating and then solidified. When the toner is a liquid toner containing a coloring pigment and thermoplastic resin in a solvent, the solvent is vaporized and dried by heat and as a result, the thermoplastic resin powders become sticky and are adhered to each other followed by solidifying as the copying member cools, to finish the fixation of the transferred images. Usually these copying steps are automatically carried out, that is, the copying member is transferred in the copying machine repeating a zigzag and a curved surface motions. Naturally, such complicated curved surface motions are continued in the fixing step and the heat fixation should be made under such motions. In general, the heat fixation is effectively conducted by closely contacting the copying member bearing the toner images with a heating surface of the fixing apparatus. Therefore, sometimes the heating surface has a complicated surface in accordance with the copying member moving in a zigzag way or a complicated curved surface way. Furthermore, it is necessary that the temperature distribution on the heating surface is uniform so as to prevent irregular fixation of the images and in addition, sometimes it is also necessary that a particular temperature distribution be maintained depending upon the required reproduction characteristics. Further important characteristic required in a heat fixing device is heating efficiency, that is, 1. The period of time from switch-on of the power source to reaching a desired temperature of the heat fixing surface is short;

2. For saving power and minimizing the size of the copying machine, heat efficiency should be high.

3. High heat efficiency results in reducing the size of the fixing device, and the small fixing device is usually of small heat content and this results in a small heat transfer to parts around the fixing device and thereby temperature of those parts is not raised so that any heat resistant or heat shielding treatment is not necessary.

In view of the foregoing, heretofore there have been used metal, quartz or heat resistant plastics for the heating surface and a copying member is closely contacted with the heating surface for the purpose of enhancing the fixation efficiency. In such case, unnecessary developer (or toner) remains on the heating surface and dirties the subsequent copying members to disturb obtaining clear images.

An example of heating members used in conventional heat fixing devices is as shown in FIG. 1(*a*) and (*b*). In FIG. 1, there is provided a heating member 2 forming a heating circuit such as shown in FIG. 1(*a*) on a heat resistant insulating base 1 and the heating member 2 is coated with a heat resistant insulating layer 3 and further with a heat conductive layer 4 such as metal plates. The surface of heat conductive layer 4 of the heating member is contacted with a developed photosensitive paper or a copying member P such as a transfer member to which developed images have been transferred and thereby the developer is subjected to heat fixation.

In the conventional heating member, the temperature distribution on the surface of the heating member should be uniform throughout the whole surface and therefore a highly heat conductive one is required and usually a metal is used. However, a metal is, in general, electroconductive so that it should be insulated from the heat generating member and a heat resistant and electrically insulating layer 3 is provided. In general, electrocally insulating material are thermally poor conductor so that it takes a long time until heat reaches a copying member P and the heat efficiency is very low. In FIG. 1(*b*), 5 and 5' represent rollers conveying the copying member P in the direction of the arrow and BL represents air pressure for urging the copying member closely to the heating member.

After a developing step, the copying member P is usually transferred to a fixing step with a developing agent on a surface A and a part of the developing agent is often transferred from copying member P to rollers 5 and 5', and then transferred onto heating surface 4 and remains and adheres there. When copying is carried out continuously, the adhered unnecessary developing agent adheres to a surface B of the subsequent copying member to form unnecessary images there and therefore the copying member is dirtied. In particular, when two-side copying (on surfaces A and B) is carried out, the images are directly dirtied and this is very disadvantageous.

Another conventional heat fixing apparatus is of a roller type as shown in FIG. 2. A copying member P passes between two heating rollers 6 and 6' rotating in the direction of the arrow and the developer is fixed. Each of rollers 6 and 6' is composed of a shaft 7, a heat generating member 8, and a heat conductive cylinder 9. Between heat generating member 8 and heat conductive cylinder 9 there is provided an air layer 10 of high specific heat so that heat conduction is poor and the heat supply from heat generating member 8 to heat conductive cylinder 9 is effected only by radiation. Thus, the heat efficiency is very low.

SUMMARY OF THE INVENTION

According to the present invention, there is provided a device for heat fixation which comprises a heating member comprising a heat resistant insulating support, a heat generating member provided on the support and a thin film of heat resistance, low surface tension and low friction coefficient overlying the heat generating member.

An object of the present invention is to provide a heat fixation device having a uniform temperature distribution on the heating surface Another object of the present invention is to provide an improved heat fixation device in which the heating speed is high after switch-on.

Further object of the present invention is to provide a heat fixation device of a small size and of high heat efficiency.

Still another object of this invention is to provide a heat fixation device in which unnecessary developer does not attach to the heating surface.

DESCRIPTION OF THE PERFERRED EMBODIMENT

Figure 3:
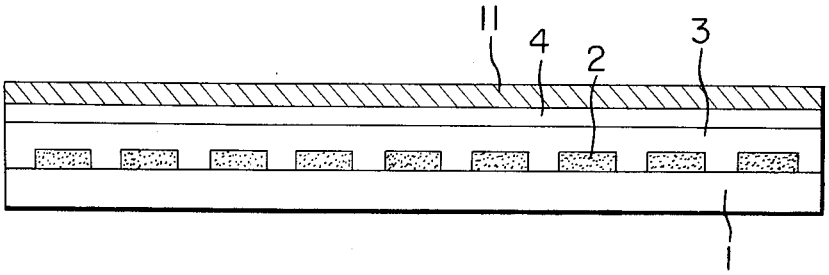
FIG. 3 shows schematically a cross sectional view of a heating member used for the heat fixation device according to the present invention.

An embodiment of the heating member of the present invention is as shown in FIG. 3. On a heating surface 4 there is provided a coating layer having a close contacting affinity with the heating surface material, heat resistance, low surface tension and low friction coefficient and composed of an organic fluorine-containing compound or a silicon-containing compound 11 (hereinafter called "coating layer"). This coating layer serves for preventing attaching of unnecessary developers and rendering once attached developers to be easily removed. For the purpose of preventing attaching of developers, the critical surface tension* the coating layer 12 is selected to be far less than that of the developer (* cf. E.H. Crook, D.B. Fordyce, G.F. Trebbi, J. Phys. Chem., 67, 1987 (1963)), and thereby, the coating layer is hardly wetted with the developer.

Representative materials for the coating layer are (1) fluorine-containing hydroxy unsaturated ester, (2) fluoroalkyl ester of acrylic acid, (3) branched, cyclic, polycyclic or crosslinked siloxane polymer or (4) silazane or its derivative having, in the molecule, at least one of hydrogen, silanol, vinyl, epoxy, acryl, amino, ester, halogen, and alkoxy such as methoxy, having a close contact affinity with the heating surface material.

From a commercial availability point of view and taking the properties into consideration, the following ones are preferable:

i. FC-706 (trade name, supplied by Minnesota Mining and Manufacturing Co.) (cf. MIL-B-81744 (AS), 27 Oct., 1969);

ii. NYE.BAR-Type C (Trade name, supplied by WILIAM.F. NYE Inc.);

iii. Braycote (Trade name, supplied by Bray Oil Co.) (The above ones are poly 1H, 1H pentadecafluorooctyl methacrylate.);

iv. FP-81 (Trade name, supplied by Sumitomo Kagaku, $$Rf.CH_2.\underset{\underset{OH}{|}}{CH}.CH_2COOCR'{=}CH_2$$

where Rf is a straight chain or branched perfluoroalkyl and R′ is hydrogen or methyl); and v. Frekote-33 (trade name, supplied by Frekote Inc., polysiloxane, silazane compound)

In particular, Frekote 33 is preferably because it can prevent attaching of a developer, its friction coefficient is as low as 0.05 and thereby little abrasion results, in addition, the heat resistance is as high as 480° C. Therefore, it has various characteristics suitable for a coating material for the heating member.

The present invention is illustrated by the following example.

EXAMPLE

In the heating member as shown in FIG. 3, the heating surface 4 is made of an anti-corrosive aluminum alloy and a solution of Frekote 33 in a mixture of oxane and methylene chloride was sprayed on the heating surface 4, dried at normal temperature for about 10 minutes and then dried by heating at 150° C for 10 minutes to form a coating layer 11 of about 5 microns.

The above mentioned coating was not decomposed up to about 480° C when measured with a test piece and the friction coefficient (kinetic friction) was as low as 0.05.

Figure 4:
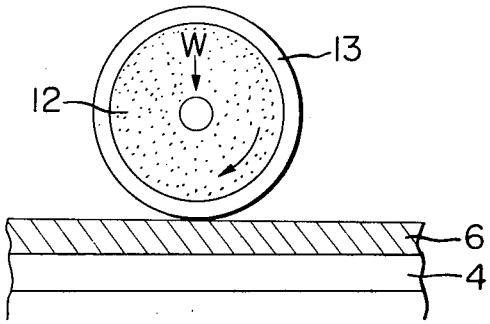
FIG. 4 is a schematical cross sectional view showing how to effect a close contact test for the heating member and a copying member.

According to the method as shown in FIG. 4, there were tested the degree of close contact between the heating member of the present invention and the effect of preventing attaching of a developer.

In FIG. 4, 12 denotes an abrasing member and 13 a paper as a copying member. Further, W is a friction load and it was 20kg/cm² here. The arrow shows the direction of rotation of abrasing member 12.

Sample A was made by coating an anti-corrosive aluminum alloy plate with Frekote 33 and Sample B was an anti-corrosive aluminum alloy plate alone. The test result is as shown in Table 1. The data in the table are angle of contact with respect to water corresponding to the number of rotations of an abrasing member.

Table 1

| Times of Friction | 0 | 10 | 50 | 100 | 200 | 500 | 1000 | 1500 |
|---|---|---|---|---|---|---|---|---|
| Sample A | 109 | 105 | 107 | 105 | 102 | 107 | 105 | 102 |
| Sample B | 34 | 36 | 33 | 39 | 35 | 31 | 32 | 34 |

Effect of preventing attaching of developers was measured by the following test.

The coating layer 11 as shown in FIG. 3 was rubbed with an abrasing member and a developer was uniformly attached to the coating layer and heated at 150° C for 15 minutes to form a solid layer of the developer. The materials of heating surface 4 and coating layer 11 were the same as above. A cellophane tape was closely attached to the solid layer of the developer and peeled to a direction at an angle of 90° as to the surface at a pulling speed of 50mm/min. with a pulling load of 10kg/cm². The same test as above was also effected for heating member without the coating layer for comparison.

The test result is shown in Table 2 below.

Table 2

| Sample | Times of friction 0 | 500 | 1000 | 1500 |
|---|---|---|---|---|
| Heating member of | ○ | ○ | ○ | ○ |

Table 2-continued

| Sample | Times of friction 0 | 500 | 1000 | 1500 |
|---|---|---|---|---|
| the present invention Heating member of control | X | X | X | X |

The sign ○ shows that the peeling of the solid developer fixed is complete which the sign means that the peeling is not possible.

The above comparison shows that the heating member of the present invention is excellent in close contact with a copying member and prevention of attaching of developers.

Figure 1:
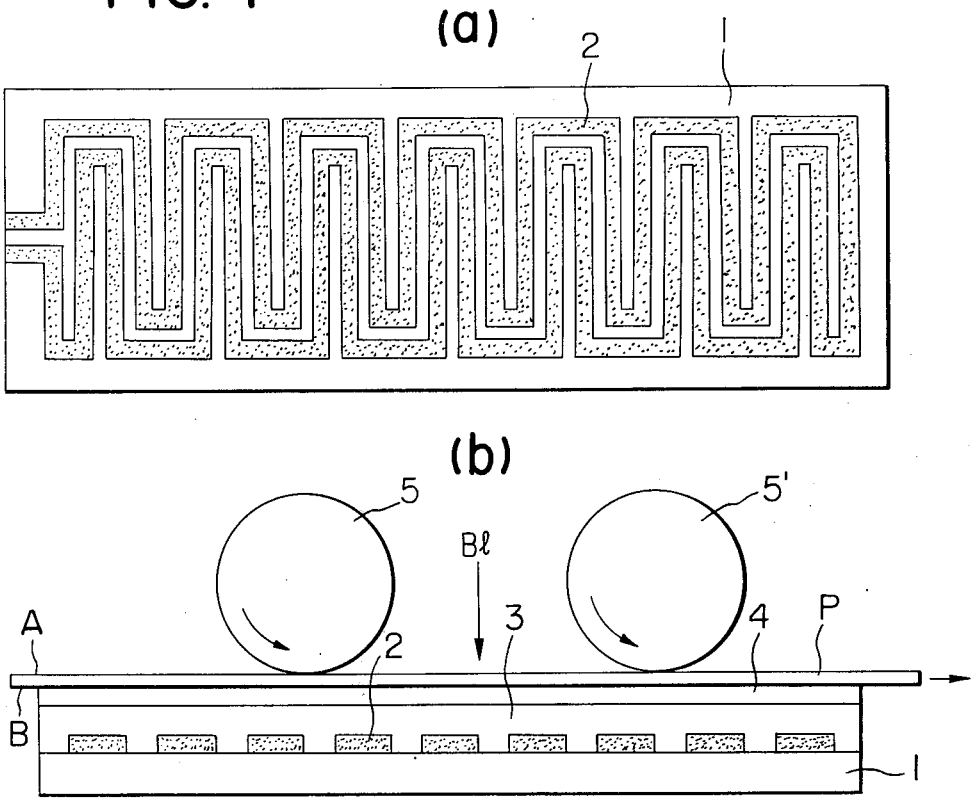
FIG. 1 and FIG. 2 diagrammatically show conventional heat fixing devices.
Figure 5:
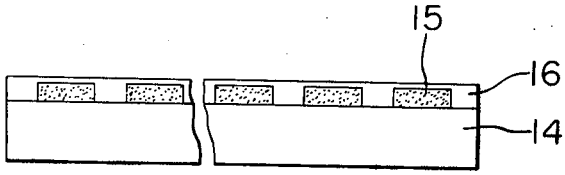
FIG. 5 - FIG. 10 diagrammatically show heat fixation devices according to the present invention.
Figure 6:
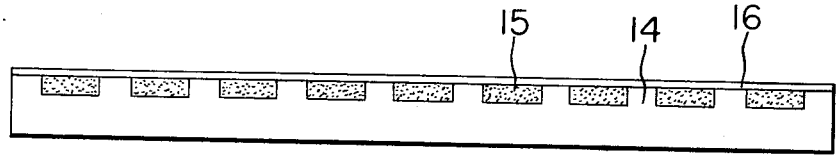

In FIG. 5 and FIG. 6, 14 denotes a heat resistant insulating base and 15 a heat generating member, for example, that having a heat generating circuit as shown in FIG. 1(*a*). The heating member comprises those parts.

FIG. 5 shows a heating member having a super thin film layer (less than 30 microns thick) 16 for the purpose of antioxidation on the heat generating member. Further this super thin film layer preferably has low surface energy for preventing attaching of developer and low friction coefficient for preventing friction between the copying paper and the heat generating member. As this thin film there may be used a heat resistant silicone in the thickness of about 200A, which is free from attaching of developers and the heat generating member is not subjected to oxidation degradation even after flowing current for 500 hours.

FIG. 6 is a heating member comprising a heat generating member 15 buried in a heat resistant insulating base 14, and a thin film layer 16 is provided on the heat generating member. The thin film layer 16 may be the same material as that of the above mentioned coating layer 11.

Figure 7:
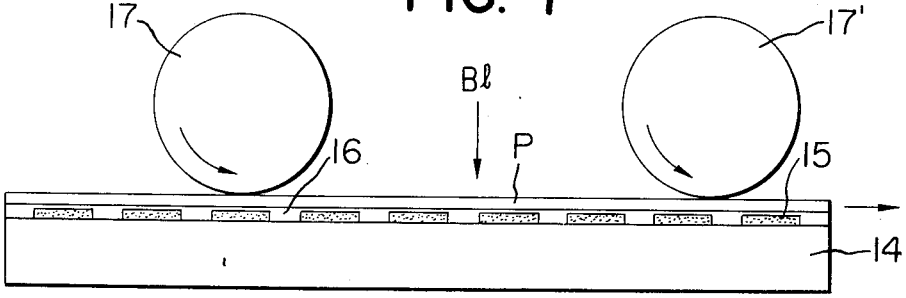

FIG. 7 shows an embodiment of the heat fixing device according to the present invention, and the heating member is that of FIG. 5 in a form of plane, but the heating member of FIG. 6 may be used instead of that of FIG. 5. Copying members P is sent in the direction of the arrow by conveying rollers 17 and 17′ rotating in the direction of the arrow. It is advisable to blow air towards the copying member with an air pressure BL to contact closely with the heating plate.

Figure 8:
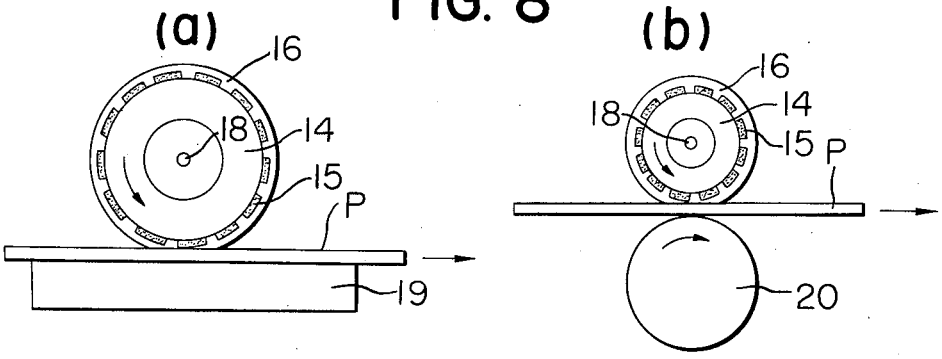

FIG. 8(*a*) and (*b*) show embodiments where the heating member is in a roller form. Naturally, the heating member of FIG. 6 can be also used in this way. 18 denotes a shaft of the heating roller and 14 a heat resistant insulating base in a form of cylinder. 15 denotes a heat generating member, which rotates in the direction of the arrow and fixes the copying member P on a support 19 by heat simultaneously with conveying the copying member P to the direction of the arrow.

In FIG. 8(*b*), there is used a rotating roller 20 in place of the support 19 in FIG. 8(*a*). It is preferable to use a heating roller as the rotating roller.

Figure 9:
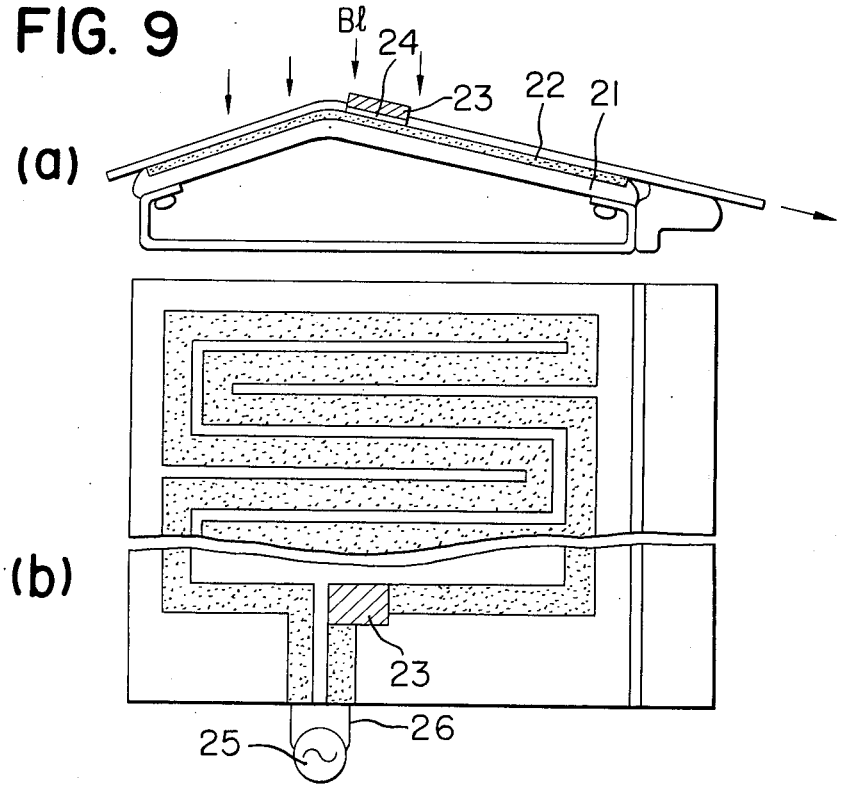
Figure 10:
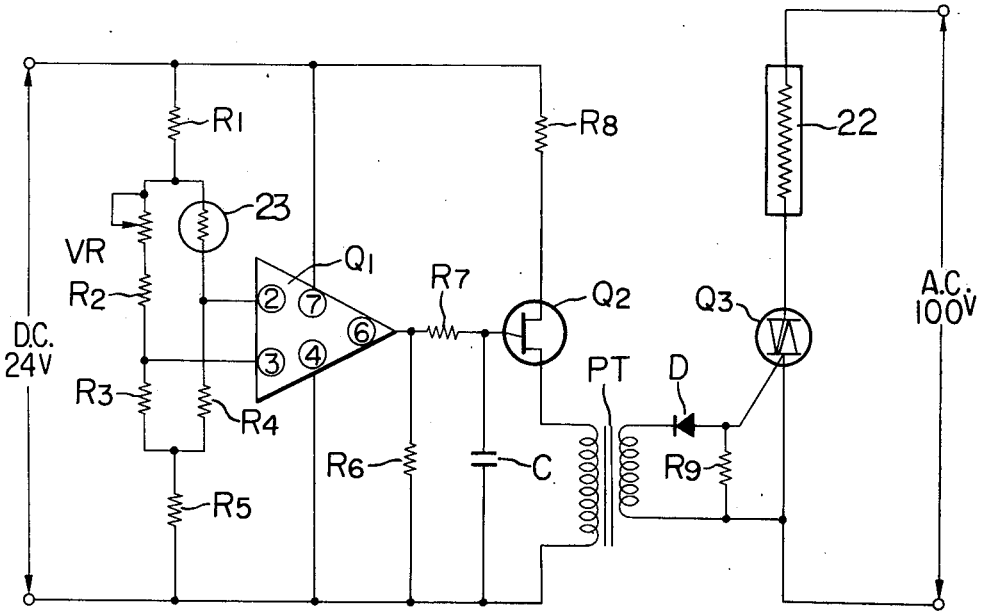

FIG. 9(*a*) and (*b*) show a further heat fixation device and (*a*) is a cross sectional view and (*b*) is a plane view. In FIG. 9, the heating member comprises an insulting support plate 21 and a heat generating member 22, and may be in a structure of FIG. 5 and FIG. 6. 23 denotes a temperature sensitive element, provided on an insulating layer 24. 26 is a lead wire of power source 25. The developer is subjected to heat fixation by passing the copying member P on the heating member of the heat fixation device. For the purpose of conducting the heat fixation always at a constant condition, it is necessary to maintain the surface temperature of the heating member of the heat fixation device at a constant value. A control circuit therefore is shown in FIG. 10. A heat resistant insulating layer 24 about 10 microns thick is provided on the heating member and a temperature sensitive element 23 is provided thereon and the change of resistance due to change of temperature is amplified to switch on or off a resistance heat generating member 22 to keep the desired temperature.

When the temperature at the point where temperature is to be sampled is lower than the temperature desired, there is brought about resistance unbalance in the bridge circuit composed of a variable resistor VR, fixed resistors R2, R3 and R4, and a thermistor 23 to provide input ports ② and ③ of a differential amplifier Q1 with voltage difference, which enables a differential amplifier Q1 to turn its output to a high level, permitting a capacitor C to be charged through a fixed resistor R7. Oscillation occurs in turn in the circuit including unijunction transistor (UJT) Q2, fixed resistor R7 and capacitor C. The oscillation output is then applied through a pulse transformer PT to the gate electrode of a triac Q3, which will turn ON to heat a resistive heat generating member 22, causing the heat member to be heated.

The resultant temperature raised by the sufficient heating exceeds a predetermined level to cause the resistance of temperature sensitive element 23, which is provided on insulating layer 24 over the heating element, to be reduced. Then, balance of resistance occurs in the aforesaid bridge circuit to provide input ports ② and ③ of the amplifer with the voltage difference of zero volts, which disables differential amplifer Q1 to produce the output of zero volts to stop the oscillation which has appeared in the oscillating circuit composed of fixed resistor R7, capacitor C and unijunction transistor (UJT) Q2. The gate input of zero volts is in turn applied to triac Q3, which will turn OFF to stop the heat generation of resistive heat generating member 22 and hence the temperature rising.

Such as electric circuitry as described above is capable of keeping the surface temperature of the heating element substantially constant by switching ON and OFF the currents through resistive heat generating member 22.

The heating member may be produced by applying etching or pressing to a conductor having resistance to produce a circuit for obtaining a desired temperature or by printing a conductor having a resistance. As the conductor having a resistance, a metal foil may be used. Further, there may be used a conductor having a thin film resistance produced by depositing a metal oxide or metal compound, and the thickness, width, area, volume and the like, are selected accordingly to give a desired watt and thereby a desired temperature. It is also possible to use a film form conductor directly as a heat generating member without any particular circuit.

The device of FIG. 9 is produced as follows. To a prepreg composed of a silicone resin reinforced with a glass cloth is applied at 350° C or higher a thermosetting silicone resin (for example, KMC-300, trade name, supplied by Shinetsu Kagaku) durable for continuous use to produce an insulating base and a foil of SUS-27 of 50 microns thick is used as a heat generating member and a heat resistant adhesive is placed between the base and the heat generating member. Then, preheating is conducted at 100° -120° C for 1 - 3 minutes, and male and female molds are used for obtaining the heating member in FIG. 9(*a*) by press shaping at 195° C for 3 minutes at a shaping pressure of 185kg/cm² followed by post-curing at 250° C for 2 hours. Then, the SUS-27 portion is etched to obtain a heat generating circuit. The heat generating circuit of SUS-27 and a power source 25 are connected with a wire 26.

Figure 2:
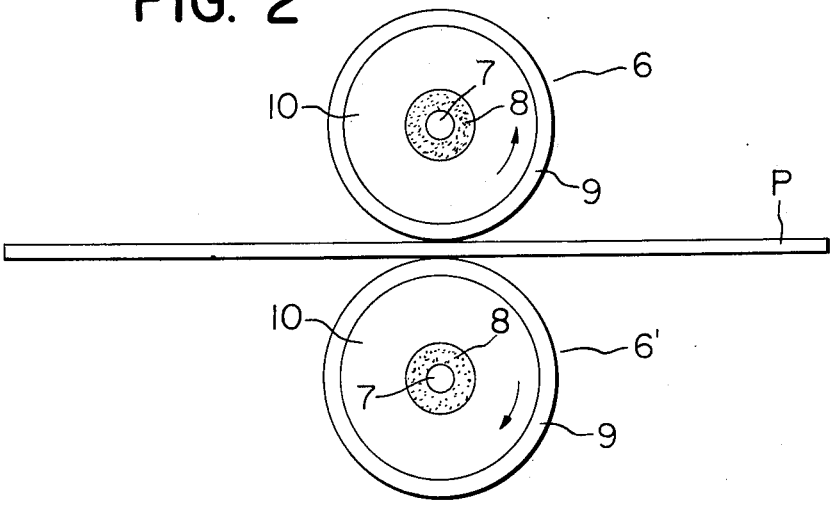

Comparing the present invention (FIG. 5 - FIG. 9) with the prior art (FIG. 1 and FIG. 2), it is clear that the prior art incorporated an insulating layer 3 and a heating member 4 between the heat generating member and the copying member P so that the temperature rise of the heating member 4 up to the desired temperature takes several minutes. On the contrary, according to the device of the present invention the heat generating member 15 almost directly contacts with the copying member P so that the desired temperature is obtained immediately after switch-on and the fixation is finished in a short time.

In this way, the heat fixation device of the present invention can give a desired temperature for heat fixation immediately after switch-on so that a high speed copying is possible and the waiting time from switch-on to beginning of copying is very short. Furthermore, heat efficiency is so high that the fixation can be effected with only low proper consumption and there can be obtained a fixation device of high efficiency, light weight and small size.

We claim:

1. In a heat fixing device for fixing an electrophotographic image developed with a developer containing a toner composition onto a copy material comprising a heating member having a heat resistant insulating support and a heat generating member on said support, the improvement for protecting the heat generating member, preventing the buildup of developer and minimizing friction and abrasion between the heat fixing device and the copy material comprising a heat resistant, thin film coating having a film thickness up to about 30 microns for said heating member overlying said heat generating member.

2. A device according to claim 1 in which the heating member is in a form of plane.

3. A device according to claim 1 in which the thin film overlying the heat generating member comprises an organic fluorinecontaining compound.

4. A device according to claim 1 in which the thin film overlying the heat generating member comprises a siliconcontaining compound.

* * * * *

UNITED STATES PATENT OFFICE

CERTIFICATE OF CORRECTION

Patent No. 4,034,189 Dated July 5, 1977

Inventor(s) Hisashi Sakamaki, et al.

It is certified that error appears in the above-identified patent and that said Letters Patent are hereby corrected as shown below:

Column 5, line 10, insert --X-- after "sign";

Column 5, line 43, "members" should read -- member --;

Column 5, line 44, "blow" should read -- flow --.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*